US006145453A

United States Patent [19]

Martin et al.

[11] Patent Number: 6,145,453

[45] Date of Patent: Nov. 14, 2000

[54] METHOD FOR CONTROLLING THE FIRING RATE OF COMBUSTION INSTALLATIONS

[75] Inventors: Johannes Martin, Munich; Peter Spichal, Greifenberg, both of Germany

[73] Assignee: Martin GmbH fuer Unwelt- und Energietechnik, Munich, Germany

[21] Appl. No.: 09/298,039

[22] Filed: Apr. 22, 1999

[30] Foreign Application Priority Data

May 5, 1998 [DE] Germany ..... 198 20 038

[51] Int. Cl.[7] ..... F23G 5/50; F23N 5/18; F23N 5/22

[52] U.S. Cl. ..... 110/346; 110/186; 110/291

[58] Field of Search ..... 110/185, 189, 110/190, 186, 248, 255, 257, 268, 285, 289, 290, 291, 235, 267, 346, 270, 274, 273 CA, 273 CB, 273 CF, 273 A, 273 LC; 414/198

[56] References Cited

U.S. PATENT DOCUMENTS

| | | | |
|---|---|---|---|
| 5,081,940 | 1/1992 | Motomura et al. | 110/346 |
| 5,261,337 | 11/1993 | Orita et al. | 110/346 |
| 5,398,623 | 3/1995 | Lautenschlager et al. | 110/346 |
| 5,606,924 | 3/1997 | Martin et al. | 110/341 |
| 5,634,412 | 6/1997 | Martin et al. | 110/101 |

*Primary Examiner*—Denise L. Ferensic
*Assistant Examiner*—Ken B. Rinehart
*Attorney, Agent, or Firm*—Reed Smith Shaw & McClay LLP

[57] ABSTRACT

In order to carry out the method for controlling the firing rate of the combustion installation, the fire grate is equipped with a plurality of undergrate zones. In order to determine the control signal, the undergrate zone at the beginning of the main combustion zone is equipped with the corresponding measurement devices, namely a temperature sensor and a pressure sensor and the associated air supply line is equipped with an airflow measuring device. A further pressure sensor is provided in the furnace space so that the static pressure difference between the undergrate zone and the furnace space can be determined. The measured values from this measurement equipment are supplied to a central computer ZR which outputs, if necessary taking account of a flow coefficient α, a control signal R to the control device RE, which is connected to the various setting devices, in order to influence the stoking speed of the grate, the fuel deposition rate, the slag removal rate and, if necessary, the airflow to the individual undergrate zones.

5 Claims, 3 Drawing Sheets

METHOD FOR CONTROLLING THE FIRING RATE OF COMBUSTION INSTALLATIONS

The invention relates to a method for controlling the firing rate of combustion installations, in particular refuse combustion installations, in which the combustible material is deposited at the beginning of a fire grate, is subjected to a stoking and forward motion on this fire grate and the resulting slag is removed at the end of the fire grate.

In the combustion of refuse, the object is to achieve a uniform release of heat from the fuel in addition to achieving a low emission of pollutants in the exhaust gas. Because the quantity of heat introduced to the fire grate per volume unit of refuse or waste is subject to large fluctuations, it is necessary, on the one hand, to vary the quantity of refuse supplied as a function of the currently available calorific value and, on the other hand, to vary the stoking and stirring of the fuel, as well as the supply of combustion air in order to permit the most uniform possible release of heat.

In the case of combustion installations with grate firing systems in which there is no automatic control of the grate stoking speed as a function of the firebed height which has been determined, this leads to the technical firing disadvantage of changeable firebed heights. Changeable firebed heights have the disadvantage of changeable permeability to combustion air of the firebed. Such changeable permeability to combustion air of the firebed lead to changeable excess air ratios and therefore to changeable combustion processes, the result of which is a lack of stable combustion and therefore unstable $O_2$ values in the exhaust gas, varying CO and $NO_x$. emissions, varying fly ash quantities and varying burn-out of the slag.

From EP 0 661 500 B1, it is known art to determine the distribution of the burning material on a fire grate by means of radar and, for example, to use this signal for the control of the stoking speed. Although this method is advantageous, it requires the use of expensive measuring equipment. Furthermore, it is not possible to draw conclusions about the permeability to air of the firebed from the firebed height which has been determined.

The object of the invention is to provide, with simple means, a method by which the firing rate can be matched relatively exactly to the steam output requirements while satisfying essential technical firing requirements with respect to the exhaust gas composition and, more particularly, with respect to CO, hydrocarbons, oxides of nitrogen and other pollutant materials.

In a method of the type explained at the beginning, this object is achieved in that the stoking and forward motion of the combustible material is at least influenced as a function of the permeability to combustion air of fire grate and firebed. This is the minimum requirement which must be satisfied in order to deal substantially with the problems of varying firebed heights. By varying the stoking motion of a grate, it is possible to adjust the burning material distribution in such a way that the permeability to air of the fire grate and firebed remains constant, by which means a stable excess air ratio and therefore substantially constant combustion with stable $O_2$ figures is achieved in the exhaust gas. By this means, furthermore, constant pollutant gas emissions at a low level are achieved. With constant permeability to combustion air through the firebed, the gas velocities through the firebed remain substantially constant and, therefore, this also achieves a low and constant quantity of fly ash removed from the firebed. Because the combustion process can be kept to a uniformly and favourable level by means of the measure in accordance with the invention, this provides good slag burn-out even during the combustion of difficult refuse materials with large variations in calorific value.

In order to make these advantageous effects reliably possible even in the case of strongly fluctuating calorific values of the fuel introduced, it is advantageous in a further development of the invention for the quantity of combustible material deposited, and in a further supplement to this measure the quantity of slag removed, to be influenced as a function of the permeability to combustion air of fire grate and firebed.

Influencing the quantity of combustible material deposited as a function of the permeability to combustion air of the fire grate and firebed takes place in a way which is superimposed on the regulation of the deposition of combustible material of the previously conventional type, as a function of the steam mass flow, for example, and therefore represents a corrective measure when it is found that the control of the stoking speed alone does not lead to optimum results.

In order to exclude any negative influence on the burning material distribution due to control of the stoking speed, it is advantageous for the quantity of slag removed to be influenced as a function of the permeability to combustion air of the fire grate and firebed because in this case, the removal of slag can be matched to the flow of burning material on the fire grate.

Using the measures in accordance with the invention, it is possible to achieve a firing rate stability with fluctuations of less than 5% even in the case of the combustion of refuse with short-term calorific value fluctuations of more than 50%.

Considered over the total length of the fire grate, the permeability to combustion air changes in accordance with the advance of combustion because the freshly deposited fuel has a permeability to air which is different from that of the fuel which is already burning or is almost completely burnt. In accordance with the present invention, it is recommended that the permeability to combustion air of the firebed should be determined in the region where combustion on the fire grate is beginning. This applies to the first part of the main combustion zone. This part should preferably be employed for determining the permeability to combustion air because the influence of the firebed height and the permeability to air of the firebed on the desired release of heat is most clearly present at this point. For this reason, this region is advantageous for the determination of the control parameter. It is here that the largest changes have to be made in order to achieve a uniform release of heat despite the varying fuel characteristics. In principle, however, the proposed control technology can be employed in any region of a combustion grate in which combustion reactions take place to a worthwhile extent.

The fundamental concept of the invention, which leads to the determination of the control parameter, consists to a first approximation in the control signal corresponding to the permeability to combustion air being determined by recording the free air outlet area of the total combustion air resistance body, composed of grate surface structure and firebed, in accordance with the equation $$R = \frac{PLB}{V}$$

where

R is the control signal,

PLB is the primary airflow through the firebed under the operating conditions and V is the flow velocity in the combustion air resistance body, composed of the grate surface structure and the firebed, and which is calculated from the equation $$V = \sqrt{\frac{2g}{\gamma_L} \cdot \Delta p}$$

where g is the gravitational acceleration, $\gamma_L$ is the specific weight of the air under the operating conditions and $\Delta p$ is the static pressure difference between the undergrate zone and the furnace space.

This way of calculating the control parameter is fundamentally sufficient for achieving the objective set at the beginning. Deviations can, however, occur from the actual relationships, these deviations being based on the fact that the combustion air resistance body composed of grate surface structure and firebed opposes the combustion airflow with greater or less aerodynamic or friction resistance as a function of the velocity of the combustion air flowing through. The air flows, in fact, through very narrow gaps between the individual grate bars of the combustion grate, on the one hand, and through the bulk consisting of waste materials and refuse, on the other. The latter do not offer any defined flow paths and their permeability to air depends not only on the height of the firebed but also on the composition of the burning material, i.e. on the refuse quality. Flow relationships then occur which can no longer be exactly represented by mathematical equations so that the fundamentals of the calculation do not always agree with the actual relationships.

On the basis of these difficulties, a way of determining the control signal in accordance with the present invention is proposed which, although it is associated with increased complication, does permit more precise matching of the control parameters determined to the actual relationships and which, in accordance with the invention, is the result of the control signal corresponding to the permeability to combustion air being determined by recording the free air outlet area of the total combustion air resistance body, composed of grate surface structure and firebed, and by recording an experimentally determined flow coefficient which depends on the flow velocity of the combustion air, in accordance with the equation $$R_K = F : \alpha$$

in which $R_K$ is the corrected control signal

F is the free air outlet area and $\alpha$ is the flow coefficient and the free air outlet area is calculated from the equation $$R = \frac{PLB}{V}$$

where

V is the flow velocity through the combustion air resistance body, composed of the grate surface structure and the firebed, and which is calculated from the equation $$V = \sqrt{\frac{2g}{\gamma_L} \cdot \Delta p}$$

where g is the gravitational acceleration, $\gamma_L$ is the specific weight of the air under the operating conditions and $\Delta p$ is the static pressure difference between the undergrate zone and the furnace space.

The experimentally determined flow coefficient is therefore a correction parameter which takes account of the aerodynamic losses due to friction and vortex formation in the airflow through the grate surface structure, i.e. through the fire grate constructed of individual grate bars and the firebed which consists of an irregular aggregation of combustible and inert waste materials of different orders of magnitude.

The invention is explained in more detail below in association with the representation in a drawing of an embodiment example of a combustion installation and using operational results in association with this combustion installation.

Figure 1:
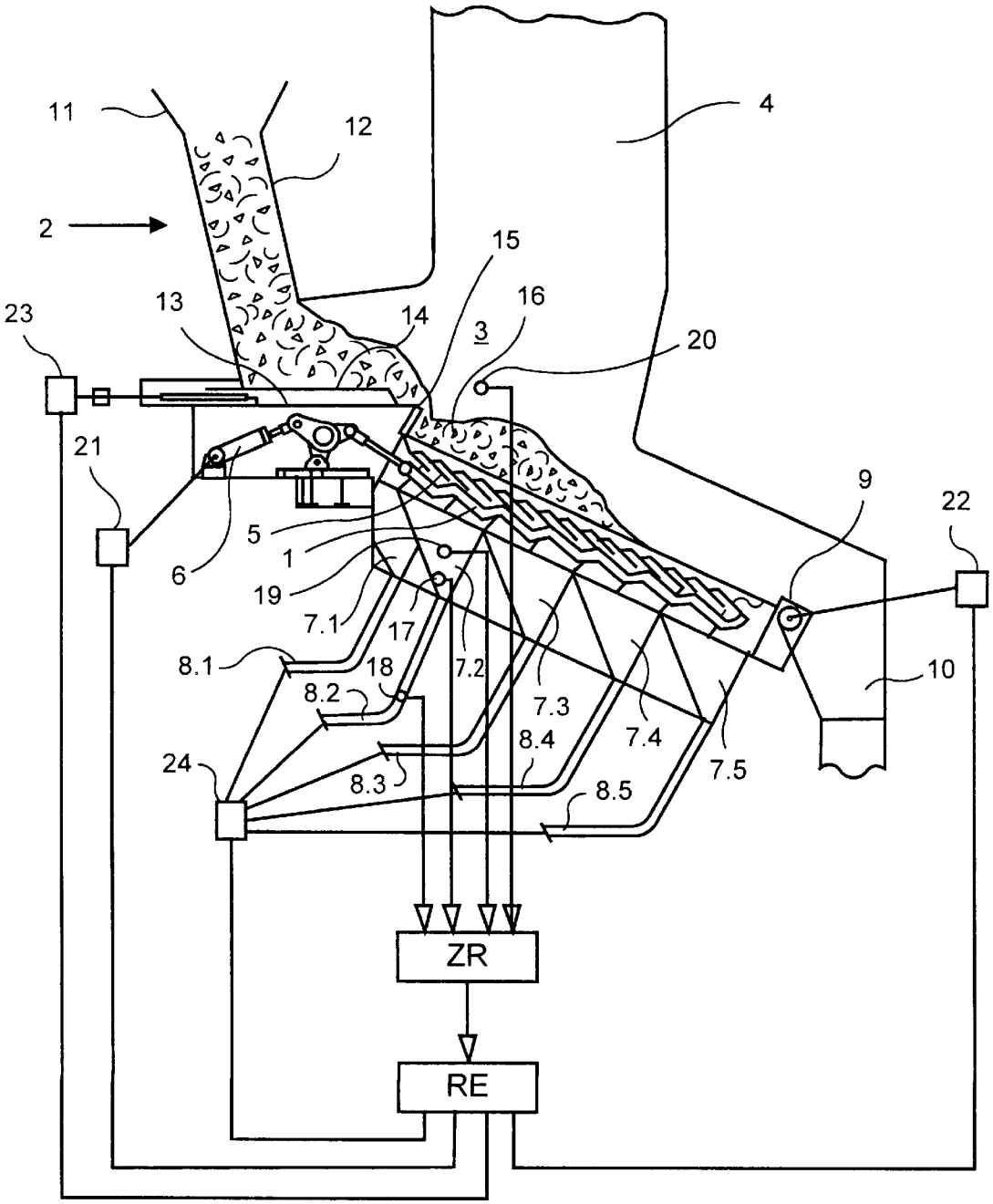
FIG. 1 shows a longitudinal section through a diagrammatically represented combustion installation.

The combustion installation represented in FIG. 1 comprises a fire grate 1, a charging device 2, a furnace space 3 with connected gas flue 4, to which are connected further gas flues and the units downstream of the combustion installation, in particular steam generation and exhaust gas cleaning installations which are not represented or explained in any more detail here.

The fire grate 1 comprises individual grate steps 5 which are in turn formed from individual, adjacently located grate bars. Every second grate step of the fire grate is configured as a reciprocating grate and is connected to a drive, designated overall by 6, which permits adjustment of the stoking speed. Undergrate chambers 7.1 to 7.5, which are subdivided in both the longitudinal and transverse directions, are provided underneath the fire grate and these chambers have primary air separately admitted via individual lines 8.1 to 8.5. At the end of the fire grate, the burnt-out slag is removed by means of a slag removal appliance, a slag roller 9 in the embodiment example shown, into a slag drop shaft 10 from where the slag falls into a slag removal unit (not shown).

The charging device 2 comprises a charging funnel 11, a charging chute 12, a charging table 13 and one or more charging pistons 14, which are allocated adjacent to one another, are possibly controllable independently of one another and push the refuse sliding down into the charging chute 12 over a charging edge 15 of the charging table 13 into the furnace space 3 and onto the fire grate 1.

The fuel 16 loaded onto the fire grate 1 is predried by the air coming from the undergrate zone 7.1 and is heated and ignited by the radiation present in the furnace space 3. The main combustion zone is in the region of the undergrate zones 7.2 and 7.3 while the slag formed burns out in the region of the undergrate zones 7.4 and 7.5 and then enters the slag drop shaft 10.

In order to determine the desired control parameter which, to a first approximation, corresponds to the free air outlet area through the grate surface structure and the firebed, an airflow measurement device 18 is provided in the air supply line 8.2 and a temperature sensor 17 and a pressure sensor 19 are provided in the undergrate chamber 7.2 while a further pressure sensor 20 is arranged within the furnace space 3 so that the static pressure difference between the undergrate zone and the furnace space can be measured.

Indicated in diagrammatic form in FIG. 1 are various setting devices, which are used to control the various factors of influence or appliances in order to permit control of the firing rate. The setting device for influencing the stoking speed is indicated by 21, that for influencing the rotational speed of the slag roller is indicated by 22, that for influencing the switch-on and switch-off frequency or the speed of the charging piston by 23 and that for the primary airflow by 24. The latter is capable of supplying the required primary airflow to each individual undergrate chamber.

Figure 2:
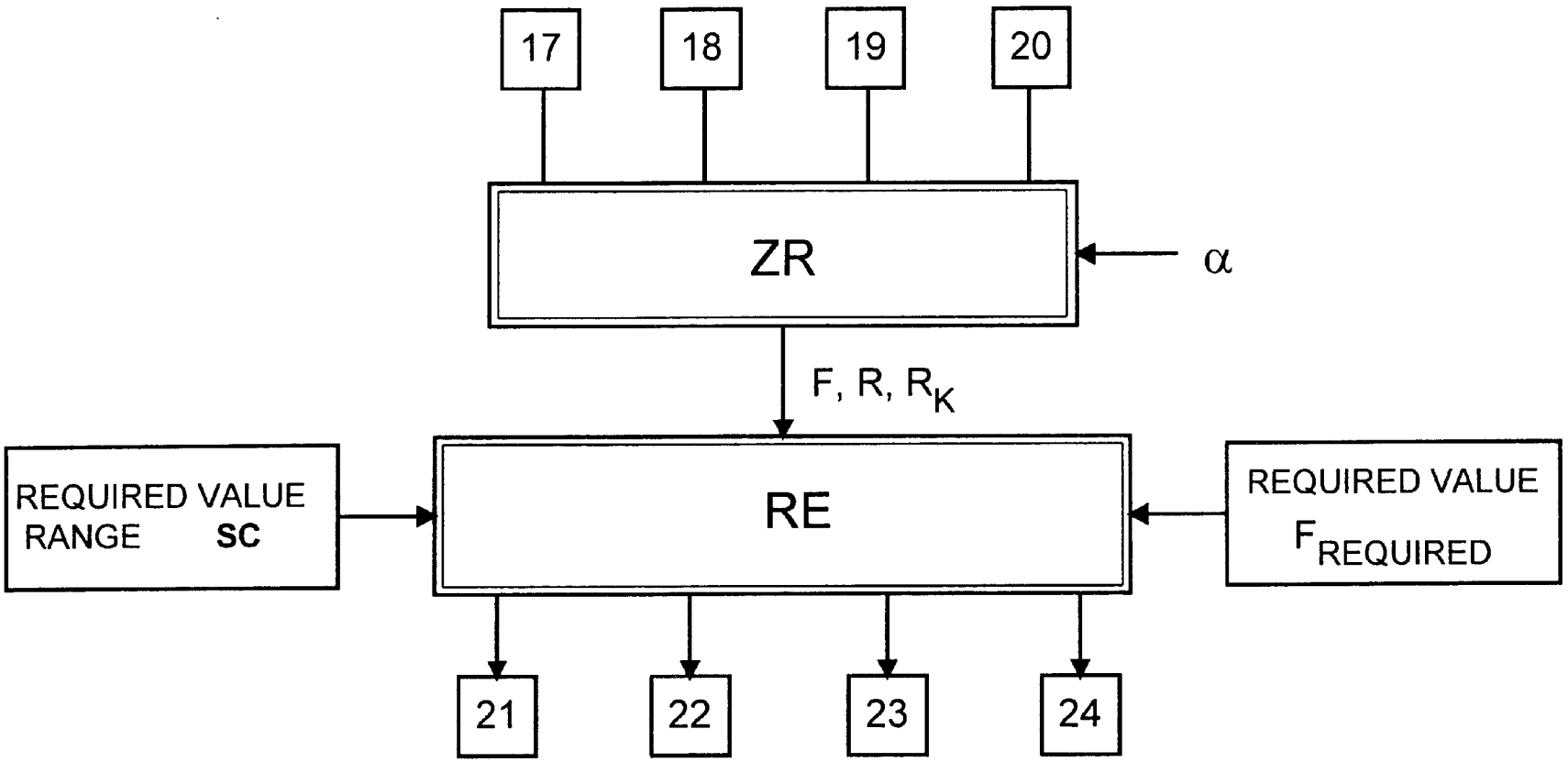
FIG. 2 shows a control scheme for the combustion installation.

The method according to the invention is explained below with additional reference to FIG. 2 and 3.

A previously conventional control unit RE (which is capable of controlling the firing rate of a combustion installation, for example as a function of the steam mass flow in terms of the fuel charge and the primary air supply, to mention only some control parameters) is configured in such a way that the required values and the actual values determined (which are necessary for carrying out the method according to the invention) can be relayed in the form of control parameters to the individual setting devices. For this purpose, a central computer unit ZR is provided which is connected to the temperature sensor 17, the airflow measurement device 18 and the two pressure sensors 19 and 20 and which processes the values measured by these sensors and devices.

In order to permit the individual control parameters to be output through the control unit RE, the control signal influencing the control unit must be calculated by the central computer ZR on the basis of the measured values. The central computer ZR therefore determines the actual magnitude of the free air outlet area which is then compared with the required value for this free air outlet area in the control unit RE and the signal for influencing the individual setting devices 21 to 24 is then derived from this.

The density of the primary air PL is calculated in known manner on the basis of the measured primary air temperature in the undergrate chamber 7.2 and the pressure measured there. This value, in association with the pressure difference between the undergrate zone and the furnace space measured by means of the two sensors 19 and 20 is used, by means of the equation $$V = \sqrt{\frac{2g}{\gamma_L} \cdot \Delta p}$$

to calculate the velocity of the primary air when flowing through the combustion air resistance body composed of grate surface structure and firebed. The value obtained in this way is used, in association with the airflow value determined by means of the airflow measurement device 18, which airflow is converted to the current operating conditions in terms of temperature and pressure, in order to calculate the free air outlet area defined in accordance with the equation $$R = \frac{PLB}{V}$$

The value obtained in this way is the actual value of the free air outlet area and is made available, as the control signal F or R, to the control unit RE where this value is compared with the required value for the free air outlet area F. This provides the setting parameters for the individual setting devices 21 to 24. The value necessary for the regulation of the stoking speed SG of the fire grate on the basis of the control signal R is then compared with the required value range for the stoking speed in order to ensure that corrections or setting steps can only take place within plausible and permissible ranges.

In this type of calculation and regulation, certain deviations can still appear. These arise because the air has to flow through a "combustion air resistance body", consisting of grate surface structure and firebed, which not only has very narrow but also extremely irregular cross-sections for the passage of the primary air. In this process, frictional losses appear which have to be taken into account in the form of a flow coefficient a in order to achieve accurate regulation. Because the flow conditions in such a firebed cannot be calculated, this flow coefficient $\alpha$ has to be determined experimentally. In order to determine this flow coefficient, the flow is first measured, at different airflows and different initial pressures in the undergrate zone, through an uncharged fire grate and then through a fire grate charged with burning material. The differences found in the pressure losses or in the respective static pressure difference between the undergrate zone and the furnace space are a measure for the formation of the flow coefficient, which assumes the value 0 when flow through the fire grate and the burning material is no longer possible and becomes greater (up to a maximum of $\alpha$=1) as it becomes easier for the air to flow unhindered through the fire grate surface structure and the burning material. In practice, the flow coefficients found are of an order of magnitude between 0.6 and 0.95. This experimentally determined flow coefficient a is input to the central computer ZR so that the control signal F or R calculated in the manner described further above can be corrected in accordance with this flow coefficient $\alpha$, so that the central computer then outputs a corrected control signal $R_K$ to the control unit. These control processes are shown diagrammatically in FIG. 2, from which it may be seen that the central computer ZR is connected to the various measurement sensors 17 to 20 and an input facility for the flow coefficient $\alpha$ while the control unit RE can receive required value inputs for the stoking speed SG and the free air outlet area F so that, from these, it can output the respective control pulses to the setting devices 21 to 24, which are connected to the control unit.

Figure 3:
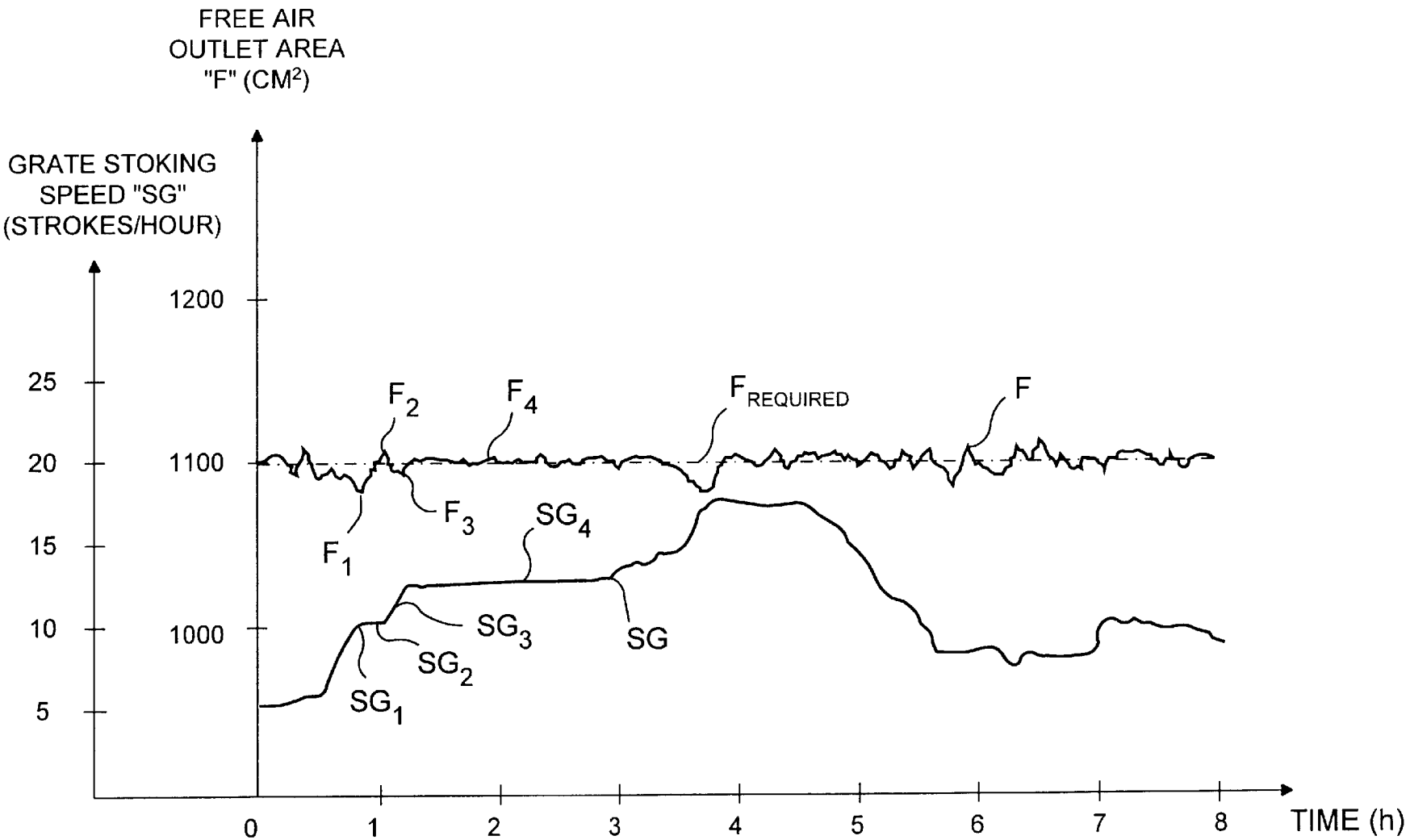
FIG. 3 shows the representation of the way in which the stoking speed of the grate depends on the control signal determined over a certain time segment.

FIG. 3 shows the result of the control process in accordance with the invention. In this, the free air outlet area F, as the control signal, and in addition the number of strokes per hour are plotted on the ordinate and the measured time is plotted on the abscissa. The constant required value for the air outlet area is represented by $F_{required}$. The curve F shows the current actual values of the control signal $R_K$ corrected by the flow coefficient $\alpha$. It may be seen that only relatively small fluctuations take place relative to the specified required value and this permits the conclusion that this combustion is taking place almost uniformly. The stoking speed of the grate is represented by SG as the number of stroke motions of the grate drive 6 per hour. It may be seen that when the free air outlet area falls, for example as far as the point F1, the stoking speed is correspondingly raised to the point SG1. A reduced free air outlet area means that the permeability to air of the firebed has been reduced either due to an increased firebed height or due to more compact burning material because of moist, inert constituents. By increasing the stoking speed, this state of affairs can be obviated or can be influenced to the extent that the free air outlet area again approaches the required value, as is the case at the point F2. It may be seen here that the stoking speed remains constant in the corresponding segment SG2. If the free air outlet area falls again at the point F3, the stoking speed increases correspondingly in the region SG3 and then remains substantially constant in the region SG4 because practically no deviations from the required value are found in the region F4.

The control interventions in accordance with the present invention do not only apply to the stoking speed of the grate, although this is the main factor of influence. So that the combustion process can be made uniform to the greatest extent possible by controlling the stoking speed, it is also necessary to influence the quantity of burning material deposited on the fire grate and the quantity of slag removed as a function of the already explained control signal R or $R_K$. This takes place by the control unit RE not only influencing the stoking speed by means of the setting device 21 but also influencing the quantity of fuel deposited on the fire grate 1 by means of the setting device 23 and the removal quantity via the removal roller 9 by means of the setting device 22. It is also possible to influence the primary airflow by means of the setting device 24, this influence being primarily exerted by the usual firing rate control system.

The control method in accordance with the invention can be used as an independent control method at least with respect to the grate speed but it can also be used as a correction only for the control of the stoking speed when the latter is controlled on the basis of other parameters by means of the usual firing rate control unit.

What is claimed is:

1. A method for controlling the firing rate of combustion installations, in particular refuse combustion installations, comprising the steps of:

depositing combustible material at the beginning of a fire grate;

subjecting the combustible material on said fire grate to a stoking and forward motion; and removing resulting slag at an end of the fire grate, the stoking and forward motion of the combustible material being at least influenced as a function of a permeability to combustion air of fire grate and firebed, a control signal corresponding to the permeability to combustion air is determined by recording a free air outlet area of a total combustion air resistance body, composed of grate surface structure and firebed, in accordance with an equation $$R = \frac{PLB}{V}$$

where R is the control siinal, PLB is a primary airflow througth the firebed under operating conditions and V is a flow velocity in the combustion air resistance body, composed of the grate surface structure and the firebed, and which is calculated from an equation $$V = \sqrt{\frac{2g}{\gamma_L} \cdot \Delta p}$$

where g is the gravitational acceleration, $\gamma_L$ is a specific weight of the air under the operating conditions and $\Delta p$ is a static pressure difference between an undergrate zone and a furnace space.

2. A method according to claim 1, wherein the quantity of combustible material deposited is influenced as a function of the permeability to combustion air of fire grate and firebed.

3. A method according to claim 1, wherein the quantity of slag removed is influenced as a function of the permeability to combustion air of fire grate and firebed.

4. A method according to claim 1, wherein the permeability to combustion air of the firebed is determined in a region where combustion is beginning on the fire grate.

5. A method for controlling the firing rate of combustion installations, in particular refuse combustion installations comprising the steps of:

depositing combustible material at the beginning of a fire grate;

subjecting the combustible material on said fire grate to a stoking and forward motion; and removing resulting slag at the end of the fire grate, the stoking and forward motion of the combustible material being at least influenced as a function of the permeability to combustion air of fire grate and firebed, a control signal corresponding to a permeability to combustion air being determined by recording a free air outlet area of a total combustion air resistance body, composed of grate surface structure and firebed, and an experimentally determined flow coefficient which depends on a flow velocity of the combustion air, in accordance with an equation $$R_{K=F:\alpha}$$

in which $R_K$ is a correct control signal, F is a fire air outlet area, $\alpha$ is a flow coefficient, and the free air outlet area is calculated from an equation $$F = \frac{PLB}{V}$$

where V is a flow velocity through a combustion air resistance body, composed of the grate surface structure and the firebed, and which is calculated from an equation $$V = \sqrt{\frac{2g}{\gamma_L} \cdot \Delta p}$$

where g is the gravitational acceleration, $\gamma_L$ is a specific weight of the air under the operating conditions and $\Delta p$ is a static pressure difference between an undergrate zone and a furnace space.

* * * * *